US006887072B2

(12) United States Patent
Judeng

(10) Patent No.: US 6,887,072 B2
(45) Date of Patent: May 3, 2005

(54) IGNITER WITH A PUSH-BUTTON AND AN ELASTIC BAR

(76) Inventor: Zhang Judeng, Ditang Town, Yuyao City, Zhejing Province (CN), 315490

( * ) Notice: Subject to any disclaimer, the term of this patent is extended or adjusted under 35 U.S.C. 154(b) by 520 days.

(21) Appl. No.: 10/028,584

(22) Filed: Dec. 20, 2001

(65) Prior Publication Data

US 2002/0150852 A1 Oct. 17, 2002

(30) Foreign Application Priority Data

Apr. 16, 2001 (CN) ..... 1238888

(51) Int. Cl.[7] ..... F23D 11/36

(52) U.S. Cl. ..... 431/153; 431/255; 431/344; 431/345; 126/406

(58) Field of Search ..... 431/153, 255, 431/344, 345; 126/406, 407

(56) References Cited

U.S. PATENT DOCUMENTS 5,326,256 A 7/1994 Shike et al. ..... 431/255
5,460,521 A * 10/1995 Tsai ..... 431/255
5,490,496 A * 2/1996 Lin ..... 126/414

(Continued)

FOREIGN PATENT DOCUMENTS

CN 23631197 Y 2/2000
WO WO 99/47855 9/1999
WO WO 99/60309 11/1999

*Primary Examiner*—Henry Bennett
*Assistant Examiner*—Kathryn Ferko
(74) *Attorney, Agent, or Firm*—Burns, Doane, Swecker & Mathis LLP

(57) ABSTRACT

Igniter with safety unit, the safety unit comprises a push-button that is arranged at the backside of the gun body and partially protrudes out of the gun body, it can be pushed forward and return relative to the gun body; a elastic limit bar that is arranged at the side of the part of the ignition trigger that is towards the backside of the gun body, in natural condition, its end keeps against a barrier block which is integrated with the inner wall of the gun body; a button that is arranged in the push-button and protrudes out of the push-button, it can be pressed into the gun body and return. A protruding part arranged on the button's inner side protrudes towards a mid-portion of the gun body. In natural condition, the protruding part is towards the blank part, but when the push-button is in pushed up condition, the protruding part is near the end of the elastic limit bar and opposite to it. Thereby, if the button is pressed down, the protruding part of the button pushes the end of the elastic limit bar to make it distort and deflect from the barrier block on the inner wall of the gun body. The locking situation of the ignition trigger can be released. The apparatus can fire the flammable gas only by doing the two compound actions i.e. pressing down the button and pushing up the push-button simultaneously, thus further improving the safety of the ignitor.

7 Claims, 5 Drawing Sheets

U.S. PATENT DOCUMENTS

| | | | | | |
|---|---|---|---|---|---|
| 5,496,169 | A | | 3/1996 | Chen | 431/153 |
| 5,697,775 | A | | 12/1997 | Saito et al. | 431/153 |
| 5,829,963 | A | * | 11/1998 | Ichikawa | 431/153 |
| 5,897,308 | A | | 4/1999 | Saito et al. | 431/153 |
| 5,915,955 | A | * | 6/1999 | Lin | 431/344 |
| 5,967,768 | A | * | 10/1999 | Saito et al. | 431/153 |
| 5,980,242 | A | | 11/1999 | Man | 431/344 |
| 6,010,328 | A | | 1/2000 | Sung | 431/153 |
| 6,022,212 | A | | 2/2000 | Saito et al. | 431/153 |
| 6,042,367 | A | | 3/2000 | Saito et al. | 431/153 |
| 6,065,958 | A | * | 5/2000 | Adams et al. | 431/153 |
| 6,077,071 | A | | 6/2000 | Yeh | 431/153 |
| 6,093,017 | A | | 7/2000 | Saito et al. | 431/153 |
| 6,126,437 | A | | 10/2000 | Lixiang et al. | 431/153 |
| 6,135,762 | A | | 10/2000 | Hu | 431/153 |
| 6,217,313 | B1 | * | 4/2001 | Luo | 431/153 |
| 6,241,511 | B1 | * | 6/2001 | Hsu | 431/255 |
| 6,293,782 | B1 | * | 9/2001 | Tsai | 431/153 |
| 6,296,475 | B1 | * | 10/2001 | Tsai | 431/153 |
| 6,296,476 | B1 | * | 10/2001 | Tsai | 431/153 |
| 6,332,771 | B1 | * | 12/2001 | Adams et al. | 431/153 |
| 6,488,493 | B2 | * | 12/2002 | Sung | 431/153 |
| 2001/0041315 | A1 | * | 11/2001 | Sung | 431/153 |
| 2001/0044085 | A1 | * | 11/2001 | Sung | 431/153 |
| 2002/0072022 | A1 | * | 6/2002 | Hsu | 431/153 |
| 2002/0132201 | A1 | * | 9/2002 | Zhang | 431/153 |
| 2003/0022122 | A1 | * | 1/2003 | Dijkstra | 431/344 |

* cited by examiner

IGNITER WITH A PUSH-BUTTON AND AN ELASTIC BAR

FIELD OF INVENTION

This invention relates to ignitor, in particularly, to one with a safety unit that can prevent it from being fired easily by children by misplay.

BACKGROUND OF THE INVENTION

The existing igniter generally comprises a gun body which can be gripped and a barrel extending away from the upper part of the gun body. A gas-fired tank and a pneumatic valve unit and a piezolighter and an ignition trigger are arranged in the gun body. Liquefied flammable gas is contained in the gas-fired tank. One can press the ignition trigger during operation, thereafter the pneumatic valve opens, at the same time, the piezolighter produces electrical spark at the port of the igniter barrel by wire to fire the flammable gas transported to the port of the igniter barrel through a transfer pipe. If people pressed the ignition trigger continuously without unloosing it, a burning flame will continue at the port of the gun barrel. So it is very convenient to operate this ignitor. Since the barrel of the igniter extends outside and is away to the hand that griping the gun body. Compared with some ignition equipment such as matchstick and lighter etc., this igniter has remarkable security and flexibility, so it is favored by people. It can be used in many occasions such as firing a gas range in a kitchen and a needfire at picnic and the birthday candle at a soiree etc. However, because it is very easy to be operated and it is like a toy by the appearance and the function and the operating method, children are in favor of playing with it and can fire it by misplay easily that will bring potential danger.

Consequently, igniter with a safety unit was designed to solve the problem mentioned above. The original safety unit is a locking switch in essence. And it has two positions as "on" and "off". When it is at "off" position, the ignition trigger is prevented from being pressed down. But many users forget to reset the ignition trigger to "off" position after igniting, so the locking switch has no function. So igniter with an improved safety unit was designed, and its safety switch has the performance of automatic return, that means when the igniter is not in use or after being used, the safety switch is at "off" position automatically, so the ignition trigger can't be pressed down from being impeded by the safety switch or associated parts. This kind of technical scheme is disposed in CN2,363,197U and U.S. Pat. Nos. 6,126,437 and 6,135,762. But all the schemes have a same characteristic, that is, increasing an ignition preparing action or pressing down the safety switch or sliding the safety switch, and then one can press down the ignition trigger to fire the flammable gas. It is very easy for children to learn this, so its security is not perfect.

SUMMARY OF THE INVENTION

The object of this invention is to provide igniter with a safety unit which can solve the problem mentioned above and can't be fired easily by children by misplay.

Another object of this invention is to provide igniter of which ignition trigger can be press down to fire the flammable gas only by doing two compound actions on the safety unit first.

The technology of this invention is in that, the igniter with safety unit comprises a gun body which can be gripped and a barrel extending outside. A gas-fired tank and a pneumatic valve unit and a piezolighter are arranged in the gun body. An ignition trigger is arranged a mid-portion of the gun body and protrudes out of the gun body, it is characterized in that the gun body further includes a safety unit, the safety unit includes:

- a push-button that is arranged at the backside of the gun body and partially protrudes out of the gun body, it can be pushed forward and return relative to the gun body;
- an elastic limit bar that is arranged at the side of the part of the ignition trigger that is towards the backside of the gun body, in natural condition, its end keeps against a barrier block which is integrated with the inner wall of the gun body;
- A button that is arranged in the push-button and protrudes out of the pushbutton, it can be pressed into the gun body and return, a protruding part arranged on the button's inner side protrudes towards the mid-portion of the gun body, in natural condition, the protruding part is towards the blank part, but when the push-button is in pushed up condition, the protruding part is near the end of the elastic limit bar and opposite to it.

In natural condition, because the elastic limit bar is prevented by the barrier block on the inner wall of the gun body, the ignition trigger can't be pressed down. But when the push-button is pushed up and its button is pressed down, or when the button is pressed down and the push-button is pushed up, the protruding part of the button pushes the end of the elastic limit bar to make it distort and deflect from the barrier block on the inner wall of the gun body. Thereby people can relief the locking situation of the ignition trigger and press it down to fire the flammable gas.

Because the apparatus of this invention can fire the flammable gas only by doing the two compound actions i.e. pressing down the button and pushing up the push-button. Adults can accomplish the two compound actions with thumb in turn. It still can be used conveniently and flexibly. Children can't learn the arcanum of this apparatus even they observe slinkingly because of the concealedness of the operation action. So this invention can further improve the safety of the ignitor.

DETAILED DESCRIPTION OF PREFERRED EMBODIMENTS

The invention will be described more details with reference to the accompanying drawing.

Figure 1:
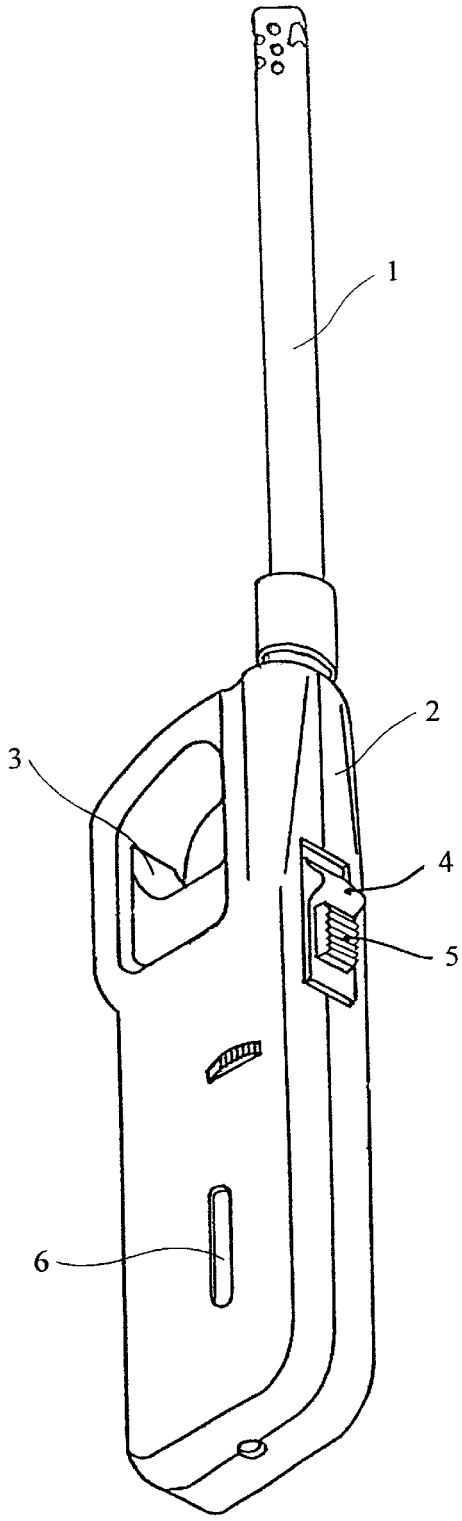
FIG. 1 is a perspective view in accordance with an embodiment of the present invention.

As shown in FIGS. 1 to 5, the igniter with a safety unit comprises a gun body 2 which can be gripped and a barrel 1 extending outside, reference to FIG. 1. A gas-fired tank and an ignition subassembly 6 consisted of a pneumatic valve unit 61 and a piezolighter 62 are arranged in the gun body 2. An ignition trigger 3 is arranged at the mid-portion of the gun body 2 and partially protrudes out of the gun body 2. A socket body 31 is arranged on one side of the ignition trigger 3 towards the backside of the gun body. An elastic limit bar 7 inserts into a longitudinal hole 32 of the socket body 31 from up to down and engages with it. The elastic limit bar 7 has a hook 71 which can chuck the upper end of the socket body 31. In natural condition, the second end 73 of the elastic limit bar 7 keeps against lower barrier block 22 which is integrated with the inner wall of the gun body 2 by mould, reference to FIGS. 2 to 5.

A push-button 4 is arranged at the backside of the gun body 2 and partially protrudes out of the gun body 2, a spring 8 is mounted in a indentation 41 of the push-button 4, the upper end of the spring 8 keeps against an upper barrier block 21 which is integrated with the inner wall of the gun body 2 by mould, reference to FIGS. 2 to 5.

Figure 2:
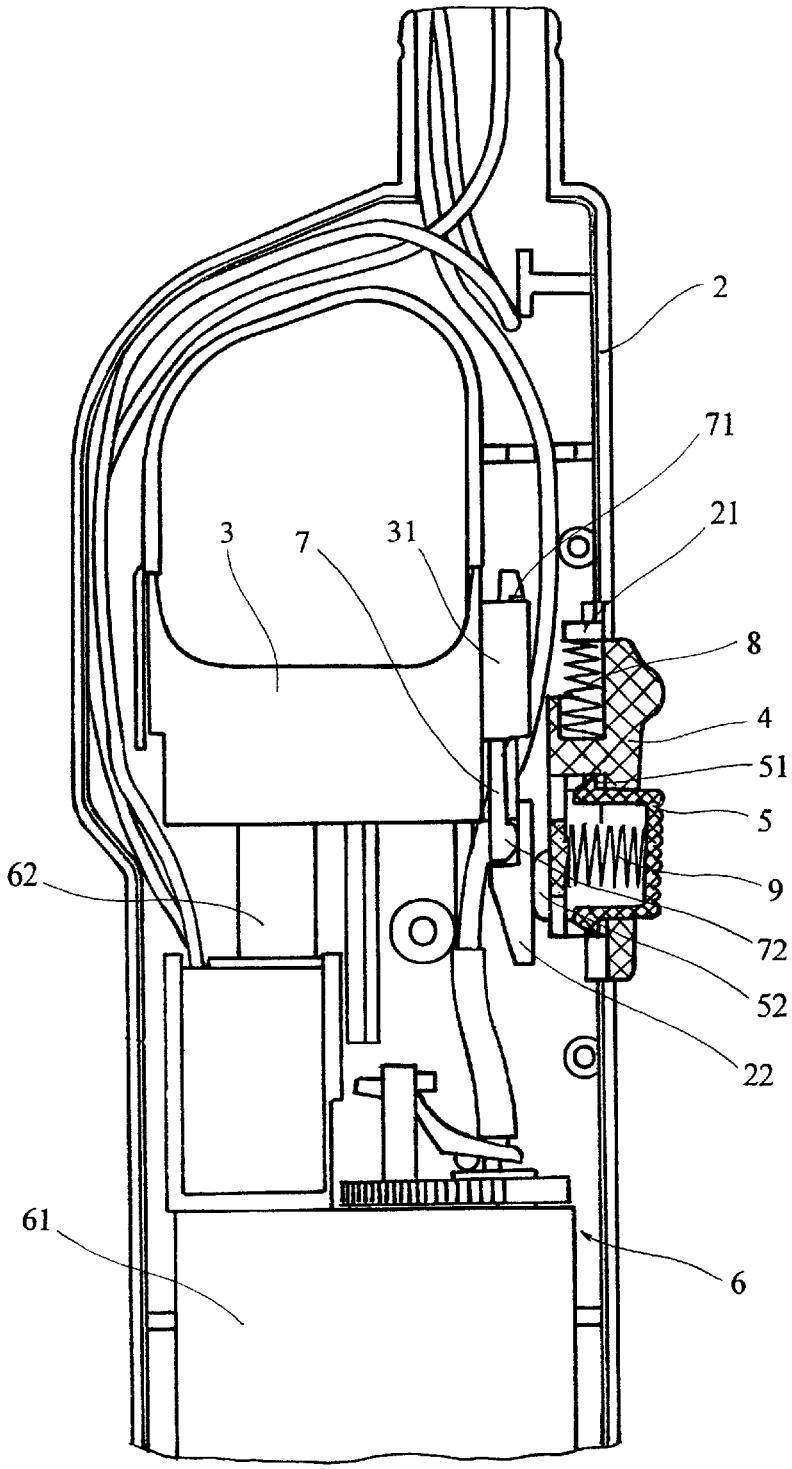
FIG. 2 is a partially cross-sectional enlarged view in accordance with an embodiment of the present invention at natural occasion.
Figure 3:
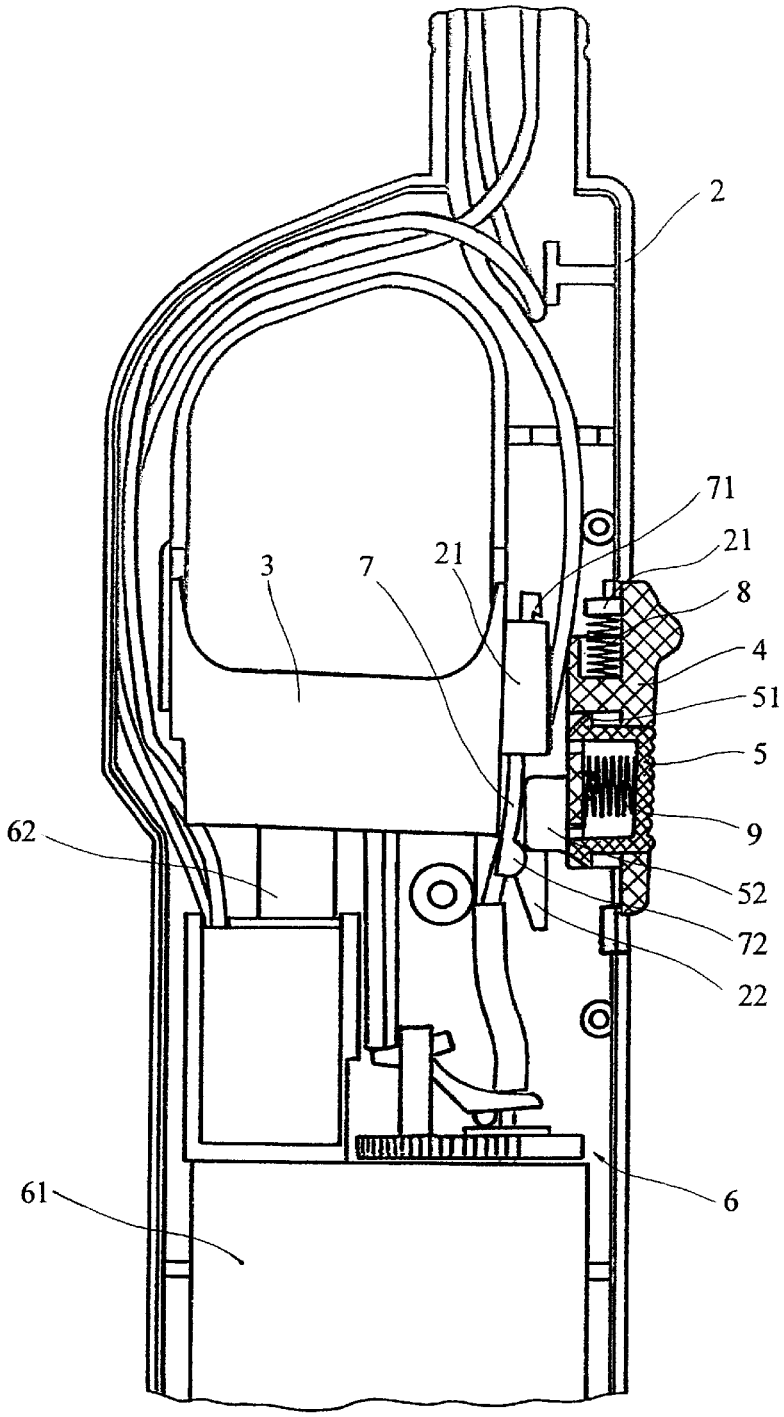
FIG. 3 is a partially cross-sectional enlarged view in accordance with an embodiment of the present invention at the occasion of preparing to fire the flammable gas.

A button 5 is arranged in the central cavity 42 of the push-button 4. The inner side of the button 5 is supported by a release spring in the cavity 42. The button 5 is limited by its hook 51 chucking the inner wall of the cavity 42 of the push-button 4 and its back protrudes out of the push-button 4. In addition, a protruding part 52 arranged on inner side of the button 5 protrudes towards the mid-portion of the gun body 2. The protruding part 52 is higher than the lower barrier block 22 and the second end 73 of the elastic limit bar 7, but it is almost in the same level with the first end 72 of the elastic limit bar. In natural condition, the protruding part 52 is towards the blank part of the gun body 2, as shown in FIG. 2, but when the push-button 4 is in pushed up condition, the protruding part 52 is near the first end 72 of the elastic limit bar and opposite to it. Hereby, if the button 5 is pressed down, the protruding part 52 of the button pushes the first end 72 of the elastic limit bar to make it distort and deflect from the lower barrier block 22 on the inner wall of the gun body. Thereby, people can release the locking situation of the ignition trigger 3, as shown in FIG. 3, so one can press down the ignition trigger 3 to fire the flammable gas; after igniting, the button 5 and the push-button 4 and the ignition trigger 3 are released, the button 5 is released to outside by the spring 9, the push-button 4 returns back by the spring 8, and the ignition trigger 3 returns back following the piezolighter 62.

In this embodiment, the first end 72 is beyond the end 73 to make the protruding part 52 push the first end 72 easily that can make the second end 73 deflect the lower barrier block 22 on the inner wall of die gun body quickly. In addition, in order to make "first pressing down the button 5 and then pushing up the pushbutton 4" and "first pushing up the push-button 4 and then pressing down the button 5" have the same effect, the first end 72 of the elastic limit bar is designed as a arc protrusion.

Figure 4:
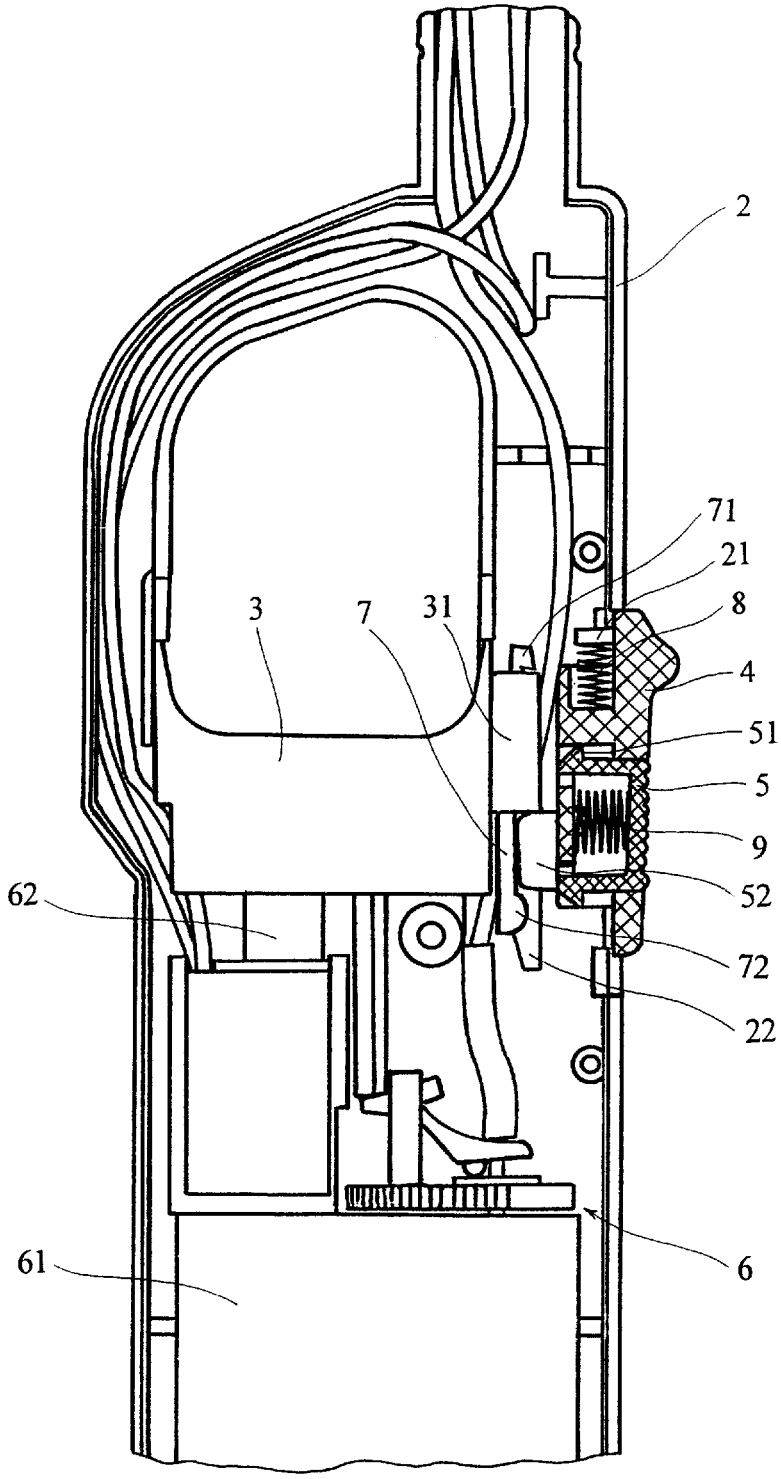
FIG. 4 is a partially cross-sectional enlarged view in accordance with an embodiment of the present invention at firing occasion.
Figure 5:
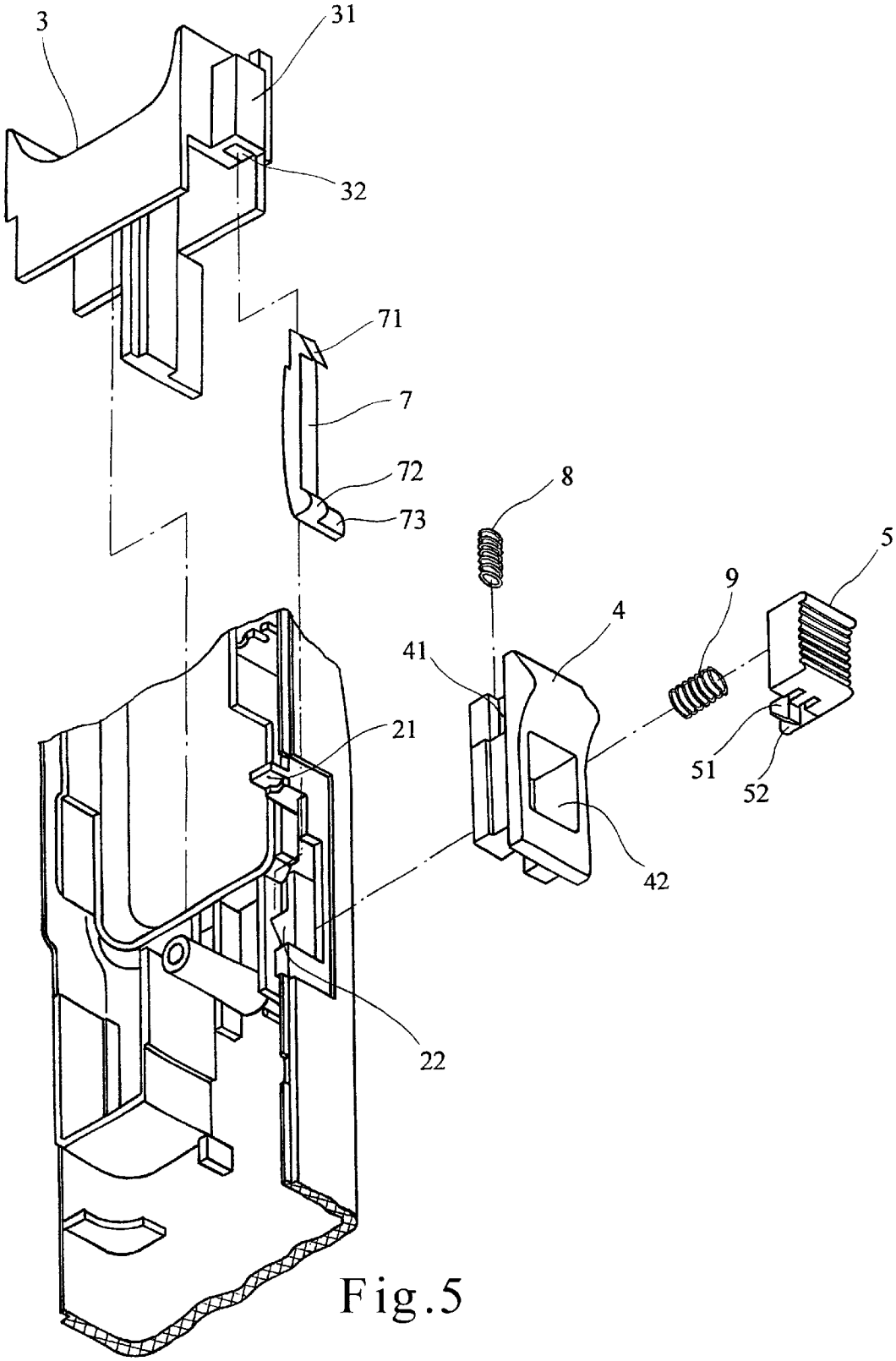
FIG. 5 is a partially perspective exploded view in accordance with an embodiment of the present invention.

In this embodiment, the appearance of the low part of the lower barrier block 22 on the inner wall of the gun body is an inverted triangle that can make the elastic limit bar 7 return to the natural shape when the ignition trigger 3 is pressed down completely to fire the flammable gas, reference to FIG. 4, so even the igniter is in a firing situation for a long time, the elastic limit bar 7 will not be destroyed by the excessive distortion.

The spring 8 and spring 9 mentioned above can be replaced by other conventional means so long as they can make the push-button 4 and the button 5 return back.

The connection relation between the elastic limit bar 7 and the ignition trigger 3 is not limited to the way provided in this embodiment, it also can utilize various fixing connection ways. All of the modifications fall into the scope of the present invention.

What is claimed is:

1. Igniter with a safety unit comprises a gun body which can be gripped and a barrel extending outside, a gas-fired tank and a pneumatic valve unit and a piezolighter are arranged in the gun body, an ignition trigger is arranged at a mid-portion of the gun body and protrudes out of the gun body, wherein the gun body includes a safety unit, the safety unit includes: a push-button that is arranged at a backside of the gun body and partially protrudes out of the gun body, the push-button can be pushed forward and returned relative to the gun body, an elastic limit bar is arranged at a side of the part of the ignition trigger that is towards the backside of the gun body, in natural condition, one end of the elastic limit bar keeps against a barrier block which is integrated with the inner wall of the gun body, a button that is arranged in said push-button and protrudes out of the push-button, the button can be pressed into the gun body and returned, a protruding part arranged on the inner side of the button protrudes towards the mid-portion of the gun body, in natural condition, the protruding part is disposed on one side of the barrier block, but when the push-button is in pushed up condition, the protruding part is disposed on an opposite side of the barrier block near the end of said elastic limit bar and opposite to it.

2. Igniter with a safety unit according to claim 1, wherein there is a protrusion on one side of said elastic limit bar opposed to a protruding part of said button.

3. Igniter with a safety unit according to claim 2, wherein the end protrusion of the elastic limit bar is designed as a arc shape.

4. Igniter with a safety unit according to claim 1 or 2 or 3, wherein a socket body with a longitudinal hole is arranged on one side of the ignition trigger towards the backside of the gun body, said elastic limit bar inserts into the longitudinal hole and engages with it, there is a hook on one end of the elastic limit bar, the hook can chuck the socket body.

5. Igniter with a safety unit according to claim 1 or 2 or 3, wherein there is an indentation in the upper part of the push-button, a spring is mounted in the indentation, the upper end of the spring keeps against a barrier block which is above the spring and integrated with the inner wall of the gun body.

6. Igniter with a safety unit according to claim 1 or 2 or 3, wherein said push-button has a central cavity, said button is arranged in this cavity, the button is limited by its hook by chucking the inner wall of the cavity of the push-button, the inner side of the button is supported by a release spring in the cavity of the push-button.

7. Igniter with a safety unit according to claim 1 or 2 or 3, wherein the low part of the barrier block fixed on the inner wall of the gun body and being against by the end of said elastic limit bar is an inverted triangle shape.

* * * * *